US005740625A

United States Patent [19]

Jenkins

[11] Patent Number: 5,740,625

[45] Date of Patent: Apr. 21, 1998

[54] FIREARM AIMING SUPPORT

[76] Inventor: Melvin R. Jenkins, 818 Fountain St., Mineral Point, Wis. 53565

[21] Appl. No.: 734,540

[22] Filed: Oct. 21, 1996

[51] Int. Cl.[6] ..... F41C 27/00

[52] U.S. Cl. ..... 42/94

[58] Field of Search ..... 42/100, 94, 103, 42/201; 33/233

[56] References Cited

U.S. PATENT DOCUMENTS

| | | | |
|---|---|---|---|
| 77,676 | 5/1868 | Swett . | |
| 758,015 | 4/1904 | Miller . | |
| 879,052 | 2/1908 | Jeranek . | |
| 989,386 | 4/1911 | Miller . | |
| 1,112,732 | 10/1914 | Uhl . | |
| 1,147,890 | 7/1915 | Purcell . | |
| 1,456,304 | 5/1923 | Fritschka . | |
| 1,666,293 | 4/1928 | Lorton . | |
| 2,690,211 | 9/1954 | Wentz | 155/135 |
| 3,156,062 | 11/1964 | Stevenson | 42/94 |
| 3,576,084 | 4/1971 | Anderson, Jr. | 42/94 |
| 3,584,821 | 6/1971 | Glebe | 248/156 |
| 4,007,554 | 2/1977 | Helmstadter | 42/94 |
| 4,089,423 | 5/1978 | Gorham et al. | 211/64 |
| 4,481,964 | 11/1984 | Minneman | 135/66 |
| 4,676,021 | 6/1987 | Groba | 42/94 |
| 4,854,066 | 8/1989 | Canterbury, Sr. | 42/94 |
| 4,882,869 | 11/1989 | Webster | 42/94 |
| 4,913,391 | 4/1990 | Klipp | 248/214 |
| 4,937,965 | 7/1990 | Narvaez | 42/94 |
| 4,972,619 | 11/1990 | Eckert | 42/94 |
| 5,180,874 | 1/1993 | Troncoso, Jr. | 42/72 |
| 5,194,678 | 3/1993 | Kramer | 42/94 |
| 5,287,643 | 2/1994 | Arizpe-Gilmore | 42/94 |
| 5,311,693 | 5/1994 | Underwood | 42/94 |
| 5,481,817 | 1/1996 | Parker | 248/286.1 |

*Primary Examiner*—Charles T. Jordan
*Assistant Examiner*—Meena Chelliah
*Attorney, Agent, or Firm*—Loyd W. Bonneville Attorney

[57] ABSTRACT

A monopod firearm aiming support to improve aim and reduce fatigue comprising a standard having disposed at one end thereof cradle within which to rest part of the firearm while aiming it, at the other end thereof a spike and proximate the spike, a foot thruster to force the standard downward into the ground, the standard in some embodiments thereof comprising means of disassembly into two separate parts threaded for reassembly.

7 Claims, 5 Drawing Sheets

FIREARM AIMING SUPPORT

BACKGROUND OF THE INVENTION

1. Field of the Invention

Hunting accessories

2. Description of the Prior Art

Numerous devices to support firearms either for hunting target practice exist in the prior art. While some of them even employ small sandbags as the gun barrel rest, they are generally configured as tripod, bipod or unipod. There have been a good many devices of considerable complexity. For military use, for example, there have been several comprised of mounts for the barrels of weapons. Game hunting has been practiced for centuries. One can only imagine the number of times a hunter may have lain a rifle barrel upon a tree branch for support while aiming. The public has yet to be presented an easily carried and stowable hunter's rifle support which is as stark in its simplicity as that provided by nature.

In general, a firearm rest permits the shooter to maintain steady aim and to prevent discharge recoil or its anticipation from spoiling that aim. Applicant's device addresses the more practical needs of easy transportability and stowage, quick on-site assembly and economy of manufacture. Safety is a further objective of the invention met by reducing the hunter's fatigue while posted awaiting the arrival of game.

The following patents teach devices applicant believes have relevance in comprising in part a spike or pointed extremity for penetration into the ground: One of the embodiments of U.S. Pat. No. 4,937,965, issued to Narvaez; U.S. Pat. No. 4,882,869 issued to Webster; U.S. Pat. No. 4,854,066 issued to Canterbury, Sr.; U.S. Pat. No. 4,676,021 issued to Groba; U.S. Pat. No. 4,481,964 issued to Minneman; U.S. Pat. No. 4,007,554 issued to Helmstadter; U.S. Pat. No. 3,584,821 issued to Gleeb; U.S. Pat. No. 3,576,084 issued to Anderson, Jr.; U.S. Pat. No. 3,156,062 issued to Stevenson, et al; U.S. Pat. No. 2,690,211 issued to Wentz; U.S. Pat. No. 1,666,293 issued to Lorton; U.S. Pat. No. 1,456,304 issued to Fritschka; U.S. Pat. No. 1,277,435 issued to Lesko; U.S. Pat. No. 989,386 issued to Miller; U.S. Pat. No. 879,052 issued to Jeranek; and U.S. Pat. No. 758,015 issued to Miller.

U.S. Pat. No. 3,156,062 issued to Stevenson, et al features a double spike. While some of the foregoing ground penetration devices are not firearm aiming supports, part of their construction is nevertheless worth noting in connection with applicant's invention. Thus, U.S. Pat. No. 4,481,964 issued to Minneman and U.S. Pat. No. 1,456,304 issued to Fritschka comprise walking sticks which, upon certain manipulation, double as short pedestals for one to sit upon. Further, the part of the latter which engages the ground is not truly a spike but merely pointed at its end, probably penetrating the ground only slightly. U.S. Pat. No. 4,882,869 issued to Webster employs as ground penetration means a knife blade and has associated with it a snare. The ground spike of U.S. Pat. No. 1,277,435 issued to Lesko doubles for use as a stabbing weapon. U.S. Pat. No. 1,666,293 issued to Lorton and U.S. Pat. No. 758,015 issued to Miller involve camping or picnic accessories and U.S. Pat. No. 989,386 issued to Miller, a support for a garden hose.

Some of the foregoing ground penetration devices include an appendage which is intended in most cases to be a means permitting one upon bearing down thereupon with a foot, to force the spike or other pointed end into the ground. In a few cases, that appendage is intended to be a ground penetration stop. This feature is consistently referred to as a foot thruster, however, because whatever may have been intended in one case or another, its configuration permits its use as a support if thrusted deeply enough into the ground. The patents having such an appendage are: U.S. Pat. No. 4,854,066 issued to Canterbury, Sr.; U.S. Pat. No. 4,007,554 issued to Helmstadter; U.S. Pat. No. 3,576,084 issued to Anderson, Jr.; U.S. Pat. No. 2,690,211 issued to Wentz; U.S. Pat. No. 1,277,435 issued to Lesko; U.S. Pat. No. 989,386 issued to Miller; and U.S. Pat. No. 879,052 issued to Jeranek. In U.S. Pat. No. 4,854,066 issued to Canterbury, Sr., it is two-piece, being comprised of opposing brackets upon which one's foot may be placed. In U.S. Pat. No. 4,007,554 issued to Helmstadter, its height is adjustable by means of a thumbscrew. That in U.S. Pat. No. 3,576,084 issued to Anderson, Jr. is strengthened in structure by a gusset, or a triangular wedge. A connecting link between the double spikes of U.S. Pat. No. 3,156,062 issued to Stevenson, et al provides the foot thrusting means. In U.S. Pat. No. 2,690,211 issued to Wentz, this feature is described merely as a collar plate. That of U.S. Pat. No. 1,277,435 issued to Lesko, it serves as a hilt for one's hand when used for stabbing as mentioned supra. The foot thruster of U.S. Pat. No. 989,386 issued to Miller folds up for stowage when not employed.

The portion of prior art devices which serves directly to support the firearm while aiming it is referred to herein as a cradle. With the exception of the devices intended for purposes other than a firearm aiming support, all of the patents cited supra have that feature. Others include: U.S. Pat. No. 5,287,643 issued to Arizpe-Gilmore; U.S. Pat. No. 1,147,890 issued to Purcell; and U.S. Pat. No. 1,112,732 issued to Uhl. U.S. Pat. No. 77,676 issued to Swett is also mentioned because, although it is intended merely as a shelf support system, the shelf thereof would serve just as suitably as a firearm aiming support as some of the others discussed herein. In U.S. Pat. No. 5,287,643 issued to Arizpe-Gilmore, the cradle is a sling suspended upon a frame which is so configured that it might itself have served as the cradle. The cradle of U.S. Pat. No. 879,052 issued to Jeranek is comprised of spring metal convoluted in a way to serve the intended purpose. U.S. Pat. No. 4,882,869 issued to Webster; U.S. Pat. No. 4,481,964 issued to Minneman; U.S. Pat. No. 4,007,554 issued to Helmstadter; U.S. Pat. No. 3,576,084 issued to Anderson, Jr.; U.S. Pat. No. 3,584,821 issued to Gleeb; U.S. Pat. No. 1,112,732 issued to Uhl; and U.S. Pat. No. 758,015 issued to Miller all are of cantilevered configuration. Thus, the cradle is suspended laterally to the main structure of the device. Those of U.S. Pat. No. 4,882,869 issued to Webster and U.S. Pat. No. 3,156,062 issued to Stevenson, et al supra, are the lower one of two thereon, the upper cradle of the former including means for emplacement of a camera. U.S. Pat. No. 4,854,066 issued to Canterbury, Sr. and U.S. Pat. No. 4,007,554 issued to Helmstadter feature fore and aft cradles both of those of the former permitting radial turning while aiming and both of those of the latter being supported upon a cantilevered supporting arm The cradle of U.S. Pat. No. 989,386 issued to Miller is a bivalvular clamp, having opposing clamshell-like concave plates for holding purposes which, if permitted to remain unfastened could serve as a firearm aiming support. The embodiment referred to in U.S. Pat. No. 4,937,965, issued to Narvaez features two cradles mounted upon a single yoke to align the firearm upon when aiming. The cradle of U.S. Pat. No. 4,676,021 issued to Groba is split, each half thereof being fastened in place.

Some of the foregoing devices are of sectional construction, permitting assembly and disassembly. Those are: The embodiment mentioned supra in U.S. Pat. No. 4,937,965, issued to Narvaez; U.S. Pat. No. 4,882,869 issued to Webster; U.S. Pat. No. 4,854,066 issued to Canterbury, Sr.; U.S. Pat. No. 4,676,021 issued to Groba; U.S. Pat. No. 2,690,211 issued to Wentz; U.S. Pat. No. 1,666,293 issued to Lorton; U.S. Pat. No. 1,456,304 issued to Fritschka; U.S. Pat. No. 1,112,732 issued to Uhl; and U.S. Pat. No. 879,052 issued to Jeranek. Of the sectional construction device references, the following are constructed such that a portion of the section farthest from the ground fits over the part it joins as a tubular sleeve: The embodiment mentioned supra in U.S. Pat. No. 4,937,965, issued to Narvaez, in which the sleeve is secured by a nut external to the sleeve; U.S. Pat. No. 4,854,066 issued to Canterbury, Sr.; U.S. Pat. No. 2,690,211 issued to Wentz; U.S. Pat. No. 1,666,293 issued to Lorton, in which the sleeved section can be rotated freely; U.S. Pat. No. 1,456,304 issued to Fritschka; U.S. Pat. No. 1,112,732 issued to Uhl, in which several such sections telescope together; and U.S. Pat. No. 879,052 issued to Jeranek.

The following employ a thumb screw, set screw or the like for height adjustment: U.S. Pat. No. 4,854,066 issued to Canterbury, Sr.; U.S. Pat. No. 4,007,554 issued to Helmstadter; U.S. Pat. No. 3,576,084 issued to Anderson, Jr.; U.S. Pat. No. 3,156,062 issued to Stevenson, et al; and U.S. Pat. No. 879,052 issued to Jeranek. In contradistinction to those devices, U.S. Pat. No. 5,287,643 issued to Arizpe-Gilmore, height adjustment is accomplished merely by tightening or loosening a threaded portion of the cradle a given amount from the structure into which it is emplaced. U.S. Pat. No. 1,456,304 issued to Fritschka and U.S. Pat. No. 1,112,732 issued to Uhl employ a pin supported by a leaf spring and a notch or hold for the pin to snap into, much in the manner of the sectional pole of a yard umbrella. The former's sectional assembly mechanism is assisted by what the inventor terms a "key" and "keyway". U.S. Pat. No. 4,882,869 issued to Webster involve spring tension arms for sectional assembly;

The sectional assemblies of some of the other devices permit height adjustment in a way not requiring fastening of two sections. A cantilevered part of the device, supporting a cradle in many cases or capable of doing so, are constructed with a ring which may be slid over the post or assembled sections. Once that has been done, the weight of the cantilevered object forces the end of the ring nearest it downward at an angle against the post. That force leads directly to friction which helps keep the parts in place. However, when a circle shaped ring has been tipped down in that fashion, the circular opening is reduced in size. Thus, by reason of the force of gravity, there is a virtual reduction in the ring's diameter. The ring cannot be slid up or down the post as it could before it was tipped at an angle. It has been observed that the greater the weight of the cantilevered object, the more is the tendency of friction and virtual reduction of diameter for the securing ring. The following of the devices cited supra utilize this principle of gravity varied virtual diameter (GVVD) for emplacement of cantilevered object, which may comprise cradle, and height adjustment: U.S. Pat. No. 4,676,021 issued to Groba; U.S. Pat. No. 4,481,964 issued to Minneman, wherein the post along which the cantilevered object is slid is comprised of scallops which also provide a partial stop to the adjusting ring; U.S. Pat. No. 3,584,821 issued to Gleeb; U.S. Pat. No. 1,666,293 issued to Lorton and U.S. Pat. No. 758,015 issued to Miller, involving camping cookware; and U.S. Pat. No. 77,676, issued to Swett, in which the post is also notched to improve reliability;

The invention is readily distinguishable from the foregoing references. The devices depicted in those references for the most part include features dedicated to improving cradle height adjustment and radial and pitch manipulation by the shooter. Even the most rudimentary of the cited references fail to meet the objectives of simplicity and low cost of manufacture addressed by applicant's invention.

SUMMARY OF THE INVENTION

The present invention is a monopod firearm aiming support featuring a two-piece upright standard assembled by joining threads seated within it, a cradle attached to one end of the standard upon which a portion of the firearm lies while the operator is aiming it for firing, a spike at the other end and an appendage upon which one's foot may be emplaced to thrust the spike into the ground.

BRIEF DESCRIPTION OF THE DRAWINGS

The parts of the invention depicted in FIGS. 1–8 are more fully described in the preferred embodiment portion of this application, ante.

FIG. 4 depicts the invention with a foot thrusting peg attached.

FIG. 5 is an embodiment of the invention in which the ends of the foot thruster are attached to the invention at two respective sites.

FIG. 6 depicts an embodiment in which a peg brace is employed in conjunction with a foot thrusting peg.

FIG. 7 depicts a gusset so employed.

FIG. 8 represents a ring configured foot thruster.

DESCRIPTION OF THE PREFERRED EMBODIMENT

Figure 1:
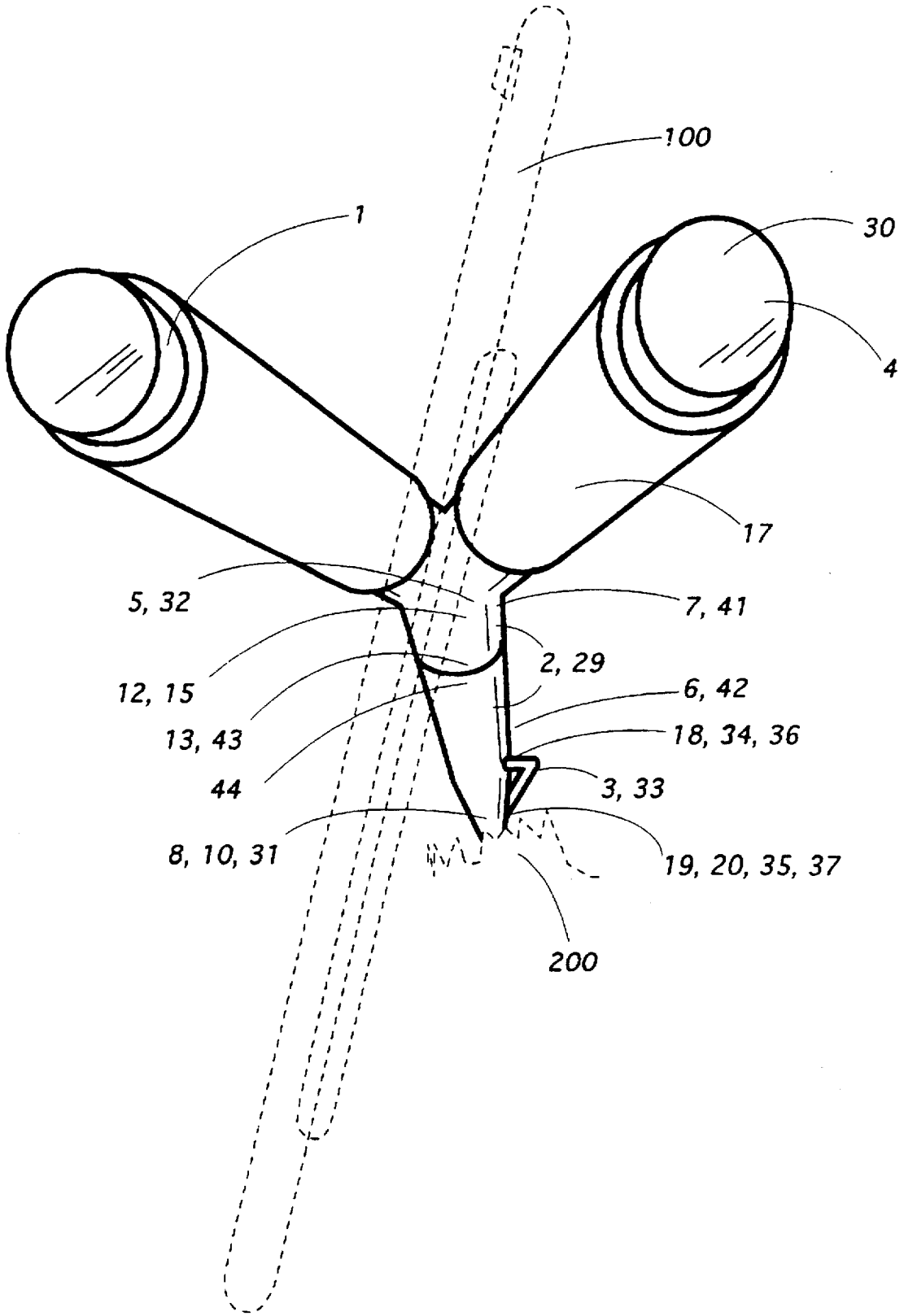
FIG. 1 is a perspective view of the invention in use.

The invention features a cradle (1) upon which part of the firearm is permitted to rest while the firearm operator aims. The cradle (1) is stated in the claims to have two prongs (4) and a vertex (5). The cradle (1) may be shaped as a V or a U, or may be configured so as to have its prongs (4) project upwards vertically at each end of a horizontal portion—that is, in U shape without rounded corners. The cradle (1) may also be shaped like a truncated V, so that it has a short horizontal portion with the prongs (4) disposed diagonally upwards. The invention does not limit the configuration of the cradle except to provide that it include the two upwards projections and a place between them in which part of a firearm may conveniently be emplaced while the operator is aiming. By way of definition, the term vertex (5) as used in the claims means not only the point at the bottom of the V shaped configuration but as well, the lowest point of the curve of the U shape or the midpoint of the horizontal portion referred to supra from which the prongs (4) extend. Preferably, the part of the prongs (4) the firearm rests upon when in use should have a cradle jacket (17) comprised of sponge, aerated plastic or other soft material.

The invention also features a standard (2) as part of its structure. The standard is recited in the claims as comprised of two principal parts, a rod (6) and a tubular sleeve (5). The tubular sleeve (5) is so designated because it fits over and envelopes part of the rod (6) in the manner generally understood concerning sleeve emplacements. Thus, the tubular sleeve (7) is hollow in the sense that any tube is hollow. The configuration of the rod (6), on the other hand, may either be hollow in the manner of a tube or solid. The latter is preferable because it affords greater strength to the invention.

The rod (6) in turn is described as having a first end (8) comprising a spike (10) and a second end (9) comprising an internally threaded receptor (11). The word spike, as used throughout this application, requires that the rod's end comprising it (8) be pointed. The rod (6) might be ovoid, rectangular, fluted or even flat in cross section. A fluted configuration might comprise ribs disposed along the portion of the rod end (8) tapering to a point. A flat rod (6) would result in a blade-like point. Preferably, for ease of manufacture in forming the spike (10), the rod (6) is shaped cylindrically with a conical point.

The internally threaded receptor (11) at the second end (9) of the rod (6) may be manufactured merely by welding a nut upon that end thereof and such construction is preferable, in view of concern for economies in manufacture. Within the tubular sleeve (7) is constructed an internally seated externally threaded post (14). The internal threads of the receptor (11) must match the external threads of the internally seated post (14), described ante, of the tubular sleeve (5).

As in the case of the rod (6), the tubular sleeve (7) is comprised of a first end (12) and a second end (13). The first end thereof (12) is described as comprising a cradle vertex attachment site (15). That designation is given merely to indicate the place the cradle's vertex (5) is attached to the tubular sleeve (7).

The word attach in its various forms as used in this application means that two parts are united in permanent fashion, such as by means of a weld, single-piece casting or extrusion, screws or an adhesive. When the union of two part is not intended as permanent, such as by assembly and disassembly, the word emplace or one of its forms is used instead of the word attach.

Figure 2:
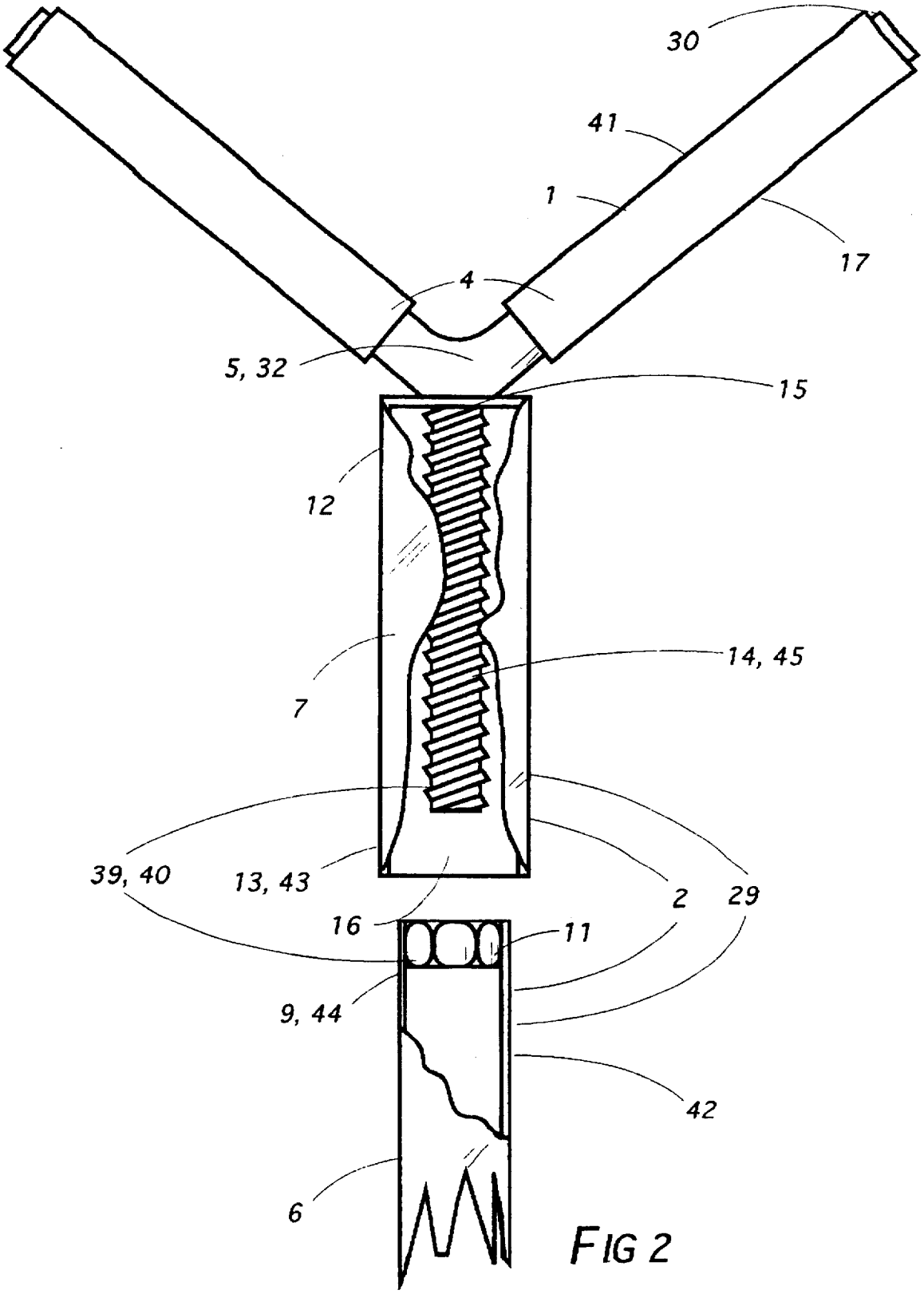
FIG. 2 is a vertical cross section depicting the threaded portions of separating and rejoining means of certain embodiments of the invention.
Figure 3:
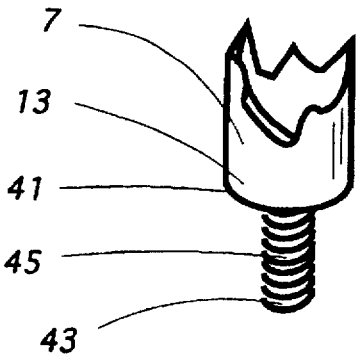
FIG. 3 represents an externally threaded post of an embodiment in which it is not internally seated within a tubular sleeve as it is in other embodiments.
Figure 4:
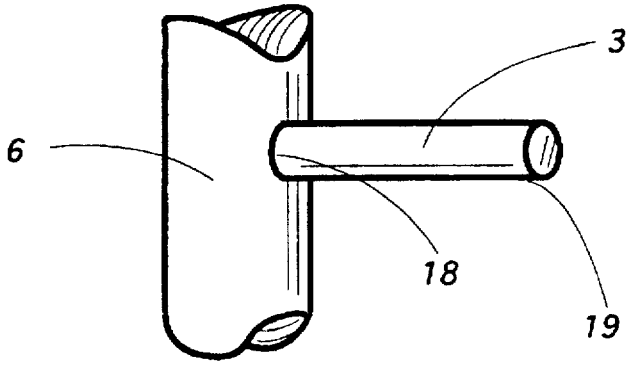
FIGS. 4–8 depict perspective views of foot thruster variations.

As mentioneed supra, the tubular sleeve (7) is also described as having an internally seated externally threaded post (14) proximate the second end thereof (13). The phrase internally seated is meant to designate that the externally threaded post (14) is attached within the tubular sleeve (7) and oriented as shown in FIG. 2. The post's (14) orientation must be such that its threads are positioned to penetrate those of the internally threaded receptor (11) at the rod's second end (9). As mentioned supra, the dimensions of the external threads of the post (14) must match those of the internal threads of the receptor (11). Thus, the threads of the two (11, 14) are described in the claims to be in mated to one another, such as in the case of a common bolt and nut. The manner in which a bolt and nut are twisted together to accomplish a snug fit is well understood in the prior art.

The tubular sleeve (7) is described as having an opening (16) at its second end (13) and the opening (16) is described as having an inner diameter greater than the outer diameter of the rod (6). By assuring that the two parts (6, 7) of the invention are of such dimension, the rod (6) may be fitted within the tubular sleeve (7) to permit them to be twisted together for emplacement. Preferably, the fit between the rod (6) and the opening of the tubular sleeve (7) should be snug to prevent dirt or moisture from entering the sleeve (7).

The invention is also described as having a foot thrusting peg (3) and that element is in turn described as being attached radially to the rod (6) proximate the spike (10). The foot thrusting peg (3) is further described as comprising a proximately attached end (18) and a distal end (19). The term proximately attached end (18) refers to the one of the two ends thereof nearer the rod (6) to which it is attached. The term distal end (19) refers to the portion thereof farthest from the rod (6). The term attached radially means that the peg (3) is oriented so as to extend outward from the rod (6) such that if the proximately attached end were extended into the rod (6), it would pass through its center. Since it is intended that one's foot would bear downward upon the peg (3) in order to push the spike (10) into the ground, its attachment site is described as being proximate the spike (10). That positioning is consistent with use of other familiar implements such as a spade or a ground emplaced tree support.

Figure 5:
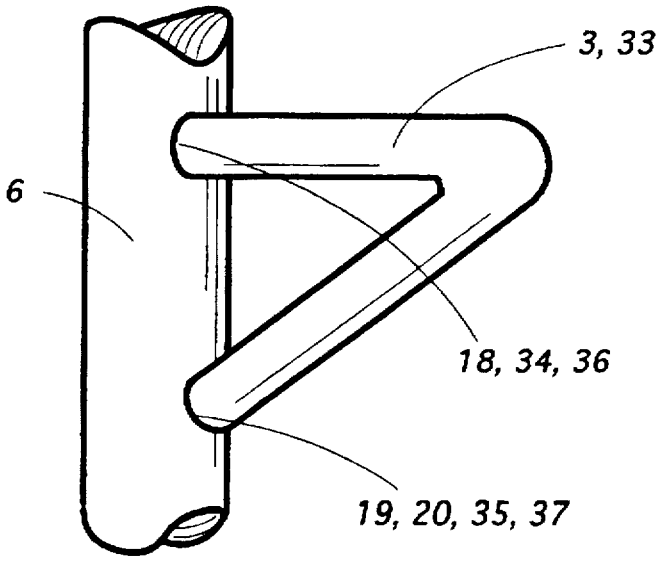

The structure of the foot thrusting peg (3) is described in some embodiments to have its distal end (19) attached to the rod (6) at a second point (20) more proximate the spike (10) than the proximately attached end thereof (18). In that embodiment, the foot thrusting peg may be considered to be extended with a portion thereof bent toward the spike (10) and to have its distal end (19) attached at a point (20) between the proximally attached end of the peg (3) and the spike (10). Thus, the configuration of the peg (3) may be considered similar to the shape of the numeral 7, and that designation is emloyed in some of the claims discussed ante. This embodiment is shown in FIG. 5.

Figure 6:
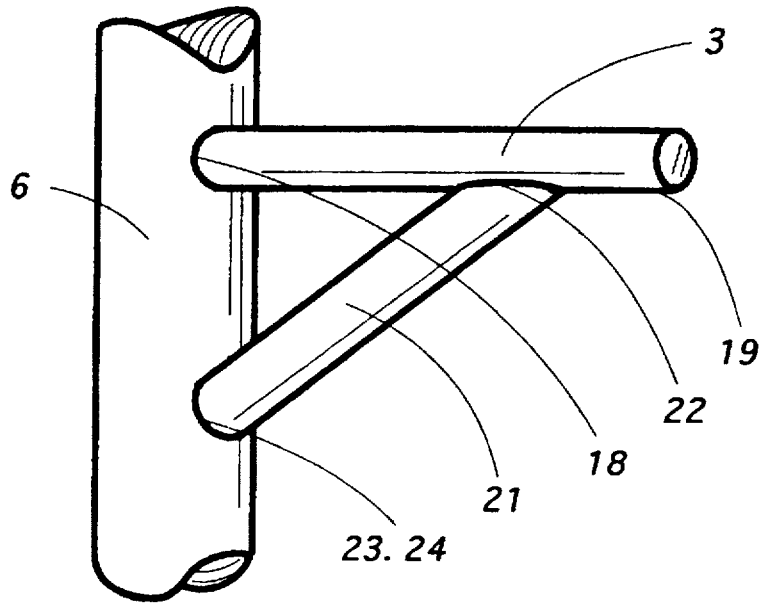
Figure 7:
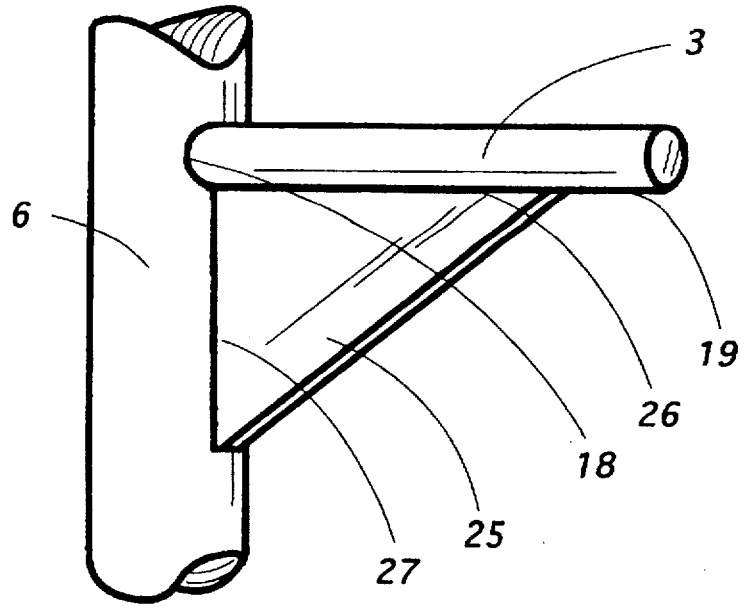
Figure 8:
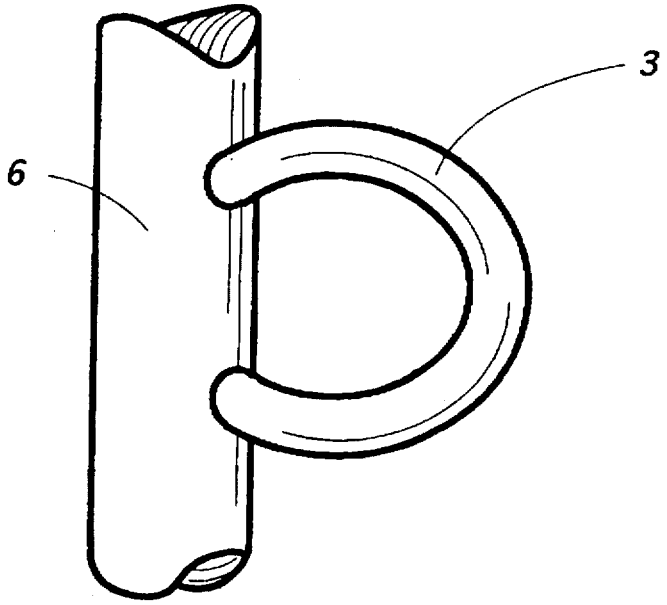

In one embodiment of the invention, the distal end (19) of the foot thrusting peg (3) is described as having a diagonal peg brace (21) attached to it as shown in FIG. 6. The diagonal peg brace (21) is described as having rod-like configuration comprising first (22) and second ends (23). The first end thereof (22) is described as being attached to the foot thrusting peg's distal end (19). The second end thereof (23) is described as being attached to the rod (6) of the standard (2). There is a point of attachment (24) of the second end (23) with the rod (6). The second end of the brace (21) is attached at that point (24), a site described as being more proximate the spike (10) than the proximally attached end (18) of the foot thrusting peg (3). The term rod-like configuration means that the peg brace (21) is comprised of what is generally understood in the prior art to be rod construction. The material must be of sufficient cross section as to afford rigidity to its structure. It is not necessary that it be of diameter equal to that of the rod (6) but it must not be as thin as what is understood in the prior art to be mere wire.

In another embodiment of the invention, the foot thrusting peg (3) is supported by a gusset (25). Gussets are known in the prior art to be pie shaped or triangular objects. They are recognized as suitable braces for cantilevered structures. The entire length of two of their three sides are usually attached to the cantilevered object and the structure from which it extends. In the embodiments of the invention under discussion here, the foot thrusting peg (3) may be considered a cantilevered object. The two sides of the gusset which are attached for support along their entire length are referred to in this application as first and a second edges (26, 27, respectively). The gusset's first edge (26) is attached along its length to the foot thrusting peg (3). The second edge thereof (27) is attached along its length to the rod (6). That, of course, leaves a third edge of the gusset (25) and that edge remains exposed, unattached to anything along any part of its length. The gusset (25) is attached such that the entirety of its second edge (27) is disposed along an attachment site (28) more proximate the spike than is the foot thrusting peg's proximately attached end (18) Otherwise stated, if the cradle (1) were considered the highest part of the invention and the spike (10), the lowest, the attachment site of the gusset's second edge (27) would be along a portion of the rod (6) below, rather than above, the foot thrusting peg (3). The manner in which the gusset (25) is disposed is shown in FIG. 6. A gusset was also referred to supra with reference to prior art in U.S. Pat. No. 3,576,084 issued to Anderson, Jr.

The invention is also described in some of the claims in an alternative manner as a one-piece object having an elongated shaft (29), a Y shaped first end (30) and a second spiked end (31). The Y shape is readily recognized as having a bifurcation (32). The letter Y is recognized as having a vertical aspect with two diagonal branches extending outward diagonally. The term bifurcation (32) is expressed to refer to the point at which the two diagonal limbs are seen to meet. It may, therefore, be said that an object may be permitted to rest within the bifurcation of a Y shaped object and it is in this respect that such language is employed in some of the claims. The invention in those claims is further described as having a foot thruster of alternative configurations. One of those is comprised of numeral 7 configuration (33). Such configuration (33) is shown in FIG. 5, which was also referred to supra in connection with an embodiment in which the foot thrusting peg's distal end (19) is attached to the rod (6) of the embodiment there discussed at a second attachment point (20). Since it would be necessary to bend a portion of the foot thrusting peg (3) toward the spike to reach that point (20), it was demonstrated supra that the peg (3) could be considered to comprise a numeral 7 configuration. It should be readily understood, then, that the configuration of the foot thruster (33) of the embodiment under discussion here is the same as that discussed supra, in which the peg (3) is bent back to attach to the rod (6) at a second attachment point (20). FIG. 5 is referred to in both instances. In the connection discussed here, the numeral 7 configured foot thruster (33) is described as having a first end (34) and a second end (35), both attached radially to the shaft at first and second attachment sites (36, 37, respectively). The term radially is the same here as defined supra and is so used throughout this application. This foot thruster (33) configuration is described in the claims under discussion here as being proximate the second spiked end (31). More specifically, the attachment sites for the foot thruster's first and second ends (34, 35, respectively) are so disposed that the second end's attachment site (37) is more proximate the embodiment's spiked end (31) than is the first end's attachment site (36). Thus, if the numeral 7 were considered to have two limbs, a horizontal one and a diagonal one, and the embodiment under discussion were considered such that its Y shaped first end (30) were oriented higher than the spiked second end (31), the diagonal limb of the foot thruster (33) would be situated on the shaft (29) beneath the horizontal limb. In use, the operator's foot would be brought to bear down upon the horizontal limb of the numeral 7 foot thruster. It should be readily recognized, therefore, that this embodiment's attachment sites (36, 37) are the same, respectively, as those discussed supra in connection with the foot thrusting peg's proximally attached end (18) and its second attachment point (20), that for the distal end (19) thereof.

A second alternative structure for the foot thruster is described in this one-piece embodiment as having ring configuration, the ring (38) being attached radially to the shaft (29). The ring (38) may be ovoid or perfectly round but must be configured so that the operator's foot fits within it. It (38) is, therefore, described in terms of inner diameter not less than four inches.

An additional embodiment relating to the one just discussed comprises separating and rejoining means (39) for the shaft (29) which permits disassembly into first and second parts (41, 42, respectively) and reassembly thereof, the parts being described to have a threaded juncture site (40). The first part thereof (41) includes as part of its structure the Y shaped first end (30) of the firearm operator's aiming support. The second part thereof (42) includes as part of its structure the aiming support's spiked second end (31). Separation is described as occuring at the joining ends (43, 44) of both the first and second parts (41, 42, respectively). Any threading means known well to the prior art are employed in disassembly and reassembly of the two parts. Thus, the first part (41) may have an externally threaded post (45), such as the shank of a bolt, and the second part (42), an internally threaded receptor (11) such as a nut and identical to that discussed supra concerning another embodiment. Alternatively, the externally threaded end may be upon the second part (42) and the threaded receptor upon the first part (41).

There is further included for the two-part (41, 42) separable embodiment just discussed, an alternative in which the first part's joining end (41) is comprised of an externally threaded seated post (14) seated within a tubular sleeve of inner diameter greater than the outer diameter of the second part (42). It should be readily recognized that the internally seated externally threaded post is the same as that discussed concerning another embodiment supra.

I claim:

1. A firearm aiming support comprising a cradle, a standard and a foot thrusting peg, the cradle comprising two prongs and a vertex joining them and disposing them separately upwards whereby part of the firearm may be permitted to rest therein, improving the firearm operator's aim and reducing fatigue; the standard comprising a rod and a tubular sleeve the rod comprising in turn a first end and a second end, the rod's first end comprising a spike, whereby the standard may be thrust downward into the ground disposing the aiming support vertically;

the rod's second end comprising an internally threaded receptor;

the tubular sleeve comprising a first end, a second end and an internally seated externally threaded post proximate the second end thereof, the tubular sleeve's first end comprising a cradle vertex attachment site at which site the cradle is attached to the tubular sleeve and the tubular sleeve's second end comprising an opening of inner diameter greater than the outer diameter of the rod, the threads of the externally threaded post being mated to those of the internally threaded receptor at the second end of the rod, wherein the rod is snugly fitted within the tubular sleeve and emplaced securely therein by twisting together the threads of the rod and those of the tubular sleeve; whereby dirt and moisture are prevented from entering the sleeve;

the foot thrusting peg being attached radially to the rod proximate the spike so as to configure it with a proximally attached end and a distal end;

whereby the operator's foot may be brought to bear downward against the foot thrusting peg in such manner as to force the spike into the ground.

2. The firearm aiming support described in claim 1, wherein the distal end of the foot thrusting peg is attached to the rod at a second point more proximate the spike than the proximally attached end thereof, whereby the foot thrusting peg is strengthened.

3. The firearm aiming support described in claim 1, further comprising a diagonal peg brace, the diagonal peg brace comprising:

rod-like configuration further comprising first and second ends, the first end thereof being attached to the distal end of the foot thrusting peg and the second end thereof to the rod of the standard at a point more proximate the spike than the proximally attached end of the foot thrusting peg.

4. A firearm aiming support comprising an elongated shaft, a Y shaped first end, a second spiked end and a foot thruster proximate the shaft's spiked end; further comprising separating and rejoining means between the Y shaped first end and the second spiked end thereof, the separating and rejoining means comprising a threaded juncture site disposing the firearm aiming support into first and second parts, a first part comprising the first end of the firearm aiming support and the second part comprising the second spiked end thereof;

the threaded juncture site comprising an externally threaded post disposed at the joining end of the first part of the firearm aiming support and an internally threaded receptor disposed at the joining end of the second part thereof;

the first part of the firearm aiming support comprising a tubular sleeve of inner diameter greater than the outer diameter of the second part thereof and the externally threaded post thereof is seated within the tubular sleeve, wherein the fit between the parts is snug, whereby dirt and moisture are prevented from entering the sleeve;

whereby part of the firearm may be permitted to rest within the bifurcation of the first Y shaped end improving the firearm operator's aim and reducing fatigue.

5. The firearm aiming support described in claim 4, wherein the foot thruster comprises numeral 7 shaped configuration comprising first and second ends attached radially to the shaft and having respective attachment sites thereon, the attachment site of the second end being disposed at a point more proximate the spiked second end of the firearm operator's aiming support than is the attachment site of the first end of the numeral 7 shaped configuration.

6. The firearm aiming support described in claim 4 wherein the foot thruster comprises ring configuration, the ring thereof comprising inner diameter not less than four inches and being attached radially to the shaft.

7. The firearm aiming support described in claim 4, wherein the internally seated, externally threaded post disposed at the joining end of the first part of the firearm aiming support comprises a machine bolt and the internally threaded receptor disposed at the joining end of the second part thereof comprises a hexagonal nut.

* * * * *